US009685289B1

(12) United States Patent
Woods

(10) Patent No.: US 9,685,289 B1
(45) Date of Patent: Jun. 20, 2017

(54) WIRELESS ALARM SWITCH ASSEMBLY

(71) Applicant: Magnasphere Corporation, Waukesha, WI (US)

(72) Inventor: Randall Woods, Sun Lakes, AZ (US)

(73) Assignee: Magnasphere Corporation, Waukesha, WI (US)

( * ) Notice: Subject to any disclaimer, the term of this patent is extended or adjusted under 35 U.S.C. 154(b) by 0 days.

(21) Appl. No.: 15/226,328

(22) Filed: Aug. 2, 2016

(51) Int. Cl.

| | |
|---|---|
| ***H01H 1/16*** | (2006.01) |
| ***H01H 36/00*** | (2006.01) |
| ***H01F 7/02*** | (2006.01) |
| *G08B 3/10* | (2006.01) |
| *G08B 13/24* | (2006.01) |

(52) U.S. Cl.
CPC ..... *H01H 36/0073* (2013.01); *H01F 7/02* (2013.01); *H01H 1/16* (2013.01); *G08B 3/10* (2013.01); *G08B 13/2494* (2013.01); *H01H 2036/0086* (2013.01)

(58) Field of Classification Search
CPC ..... H01H 1/16; H01H 36/0073; H01H 2036/0086
See application file for complete search history.

(56) References Cited

U.S. PATENT DOCUMENTS

| | | | |
|---|---|---|---|
| 5,332,992 | A | 7/1994 | Woods |
| 5,530,428 | A | 6/1996 | Woods |
| 5,673,021 | A | 9/1997 | Woods |
| 5,880,659 | A | 3/1999 | Woods |
| 5,977,873 | A | 11/1999 | Woods |
| 6,087,936 | A | 7/2000 | Woods |
| 6,506,987 | B1 | 1/2003 | Woods |
| 6,603,378 | B1 | 8/2003 | Collins |
| 7,023,308 | B2 | 4/2006 | Woods |
| 7,291,794 | B2 | 11/2007 | Woods |
| 7,825,801 | B2 | 11/2010 | Woods |
| 8,228,191 | B2 | 7/2012 | Woods |
| 8,314,698 | B2 | 11/2012 | Woods |
| 8,648,720 | B2 | 2/2014 | Woods |

*Primary Examiner* — Ramon M Barrera
(74) *Attorney, Agent, or Firm* — Hovey Williams LLP

(57) ABSTRACT

Switch apparatus (10) includes a switching assembly (16) and an operating component assembly (18) respectively designed for mounting upon relative shiftable members, such as a door (12) and frame (14). The assembly (16) includes a magnetic switch unit (30) having an elongated housing (40), first and second spaced apart switch elements (36, 38), and a shiftable, electrically conductive body (50) within the housing and movable between a first switch state where the body is in simultaneous contact with the switch elements (36, 38), and a second switch state where the body is not in such simultaneous contact. In order to prevent unauthorized opening of the relatively shiftable members through use of an external defeat magnet (62), the switch unit (30) is mounted substantially horizontally rather than in an upright or oblique orientation.

14 Claims, 3 Drawing Sheets

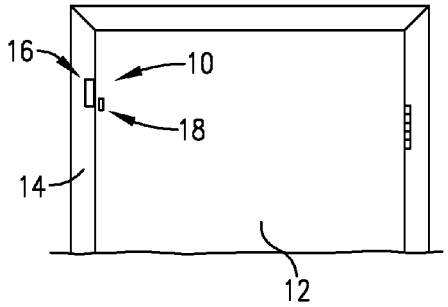
FIG. 1.
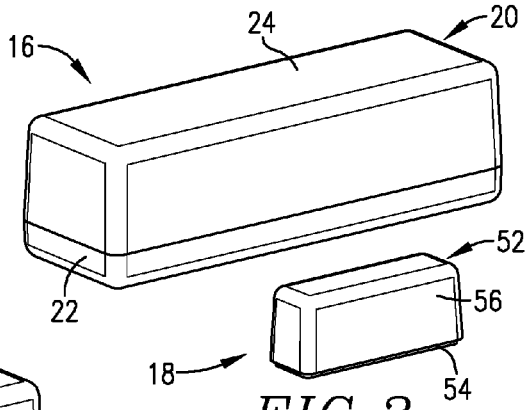
FIG. 2.
FIG. 3.
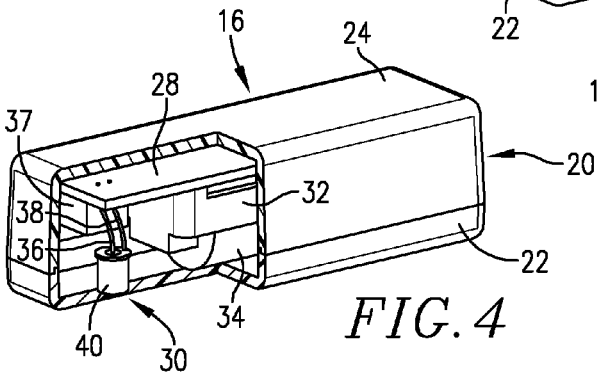
FIG. 4
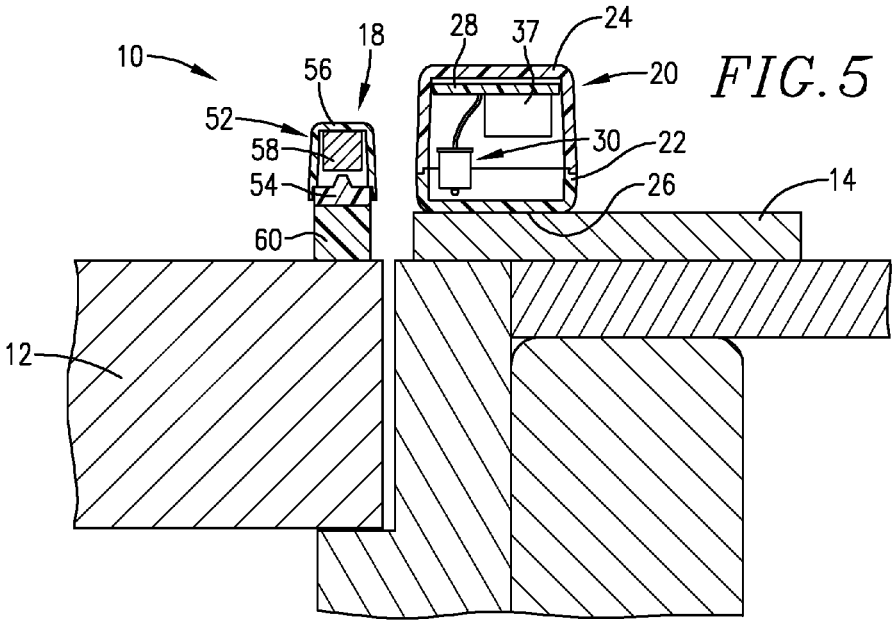
FIG. 5

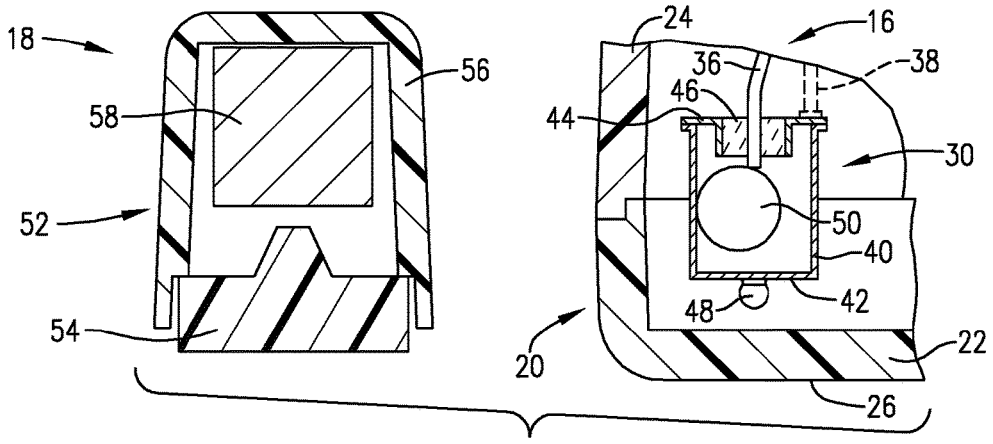
FIG. 5A.
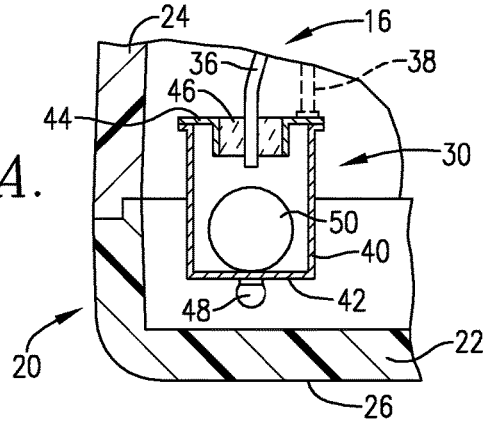
FIG. 6A.
FIG. 7A.
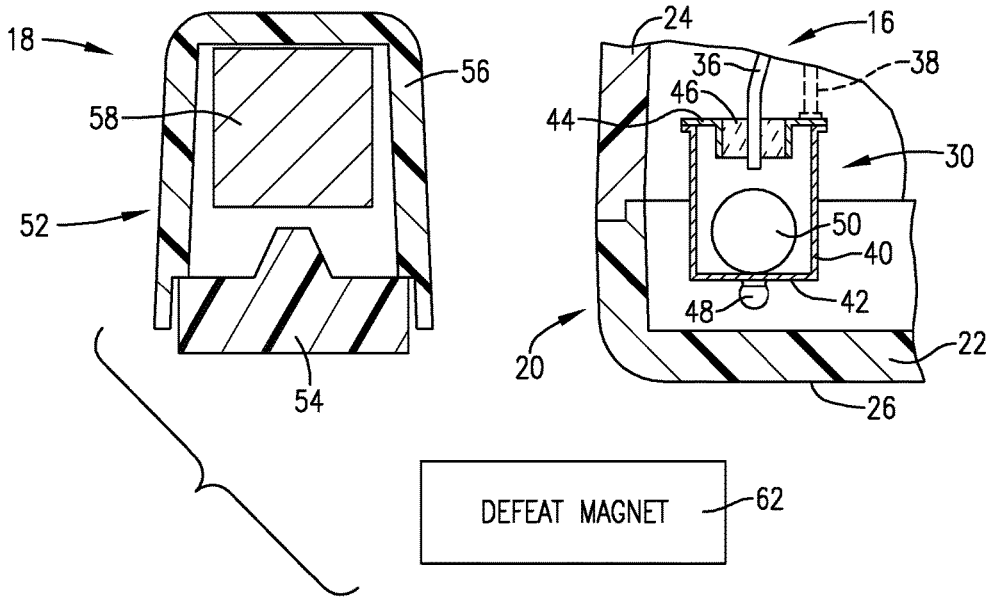

WIRELESS ALARM SWITCH ASSEMBLY

BACKGROUND OF THE INVENTION

Field of the Invention

The present invention is broadly concerned with improved, high security switch apparatus, which can be used as a part of an alarm system responsive to unauthorized opening of a door or the like of a protected structure. More particularly, the invention is concerned with such apparatus which makes use of a ball-type magnetic switch assembly having an elongated housing and a magnetically shiftable ball therein. The ball traverses a path of travel between respective switch states which is oriented substantially horizontally, in order to prevent defeat of the alarm system through use of a defeat magnet located on the exterior of the protected structure.

Description of the Prior Art

Prior art security alarm systems often make use of magnetic switches attached to doors and windows and integrated with the system for detecting unauthorized openings. One common type of magnetic switch used in these situations is a so-called reed switch. It has been found that reed switches are subject to unauthorized manipulation through use of an external magnet. Specifically, an intruder can hold a relatively strong magnet adjacent the reed switch which will then be operated (to either open or close depending on the control scheme). With this accomplished, an intruder can open the door or window without triggering the alarm system.

A number of magnetic switches have been proposed in the past to overcome the inherent deficiencies of reed switches. U.S. Pat. Nos. 5,332,992, 5,530,428, 5,673,021, 5,880,659, 5,977,873, 6,087,936, 6,506,987, 6,603,378, 7,023,308, 7,291,794, 7,825,801, 8,228,191, and 8,314,698 describe switches of this type. These switches typically include a pair of spaced apart switch elements with a shiftable body (e.g., a spherical ball) vertically movable within an upright housing between a first position where the ball is in simultaneous contact with both elements and a second position out of such simultaneous contact. An alarm circuit is operatively coupled with the switch elements so as to detect movement of the body. These switches represent a very significant advance in the art. The Magnasphere Corporation of Waukesha, Wis., has commercialized a series of magnetic switches of this type.

U.S. Pat. No. 8,648,720 describes a magnetic ball switch which is specifically designed for protecting an internal door or the like within a building or other structure, e.g., a high-security coding room. The '720 patent describes a switch assembly which is suitable for mounting on an internal door frame and door, and protects against an attempted illegal entry making use of a defeat magnet placed adjacent the internally mounted switch assembly. To this end, the switch assembly provides a magnetic ball switch which is oriented at an oblique angle relative to the horizontal so that attempted opening via an internal defeat magnet will activate an alarm. However, the switch assembly of the '720 patent is not appropriate for protecting an exterior door or window which would provide a potential entryway from the exterior of the building or structure to the interior thereof.

SUMMARY OF THE INVENTION

The present invention overcomes the problems outlined above and provides magnetic switch apparatus for detecting relative movement between first and second members (e.g., a door and door frame) from a close position wherein the members are proximal, and an open position where the members are separated, the first and second members providing a potential entryway from the exterior of a structure to the interior thereof. The apparatus is especially designed to prevent unauthorized separation of the first and second members through use of an external defeat magnet.

Broadly speaking, the switch apparatus includes a switch assembly for mounting on one of the members in the interior of the structure and having an elongated housing presenting a central axis and having first and second, spaced apart, electrically conductive switch elements; and a shiftable, electrically conductive body within the housing and movable between a first switch state wherein the body is in simultaneous contact with the first and second switch elements, and a second switch state wherein the body is not in simultaneous contact with the first and second switch elements. A biasing component is provided which is proximal to the housing, and is magnetically correlated with the switch unit such that when the first and second members are in the open position, the biasing component magnetically maintains the body in one of the switch states.

An operating component is also provided for mounting on the other of the members in the interior of the structure, the operating component and switch assembly being magnetically correlated such that when the first and second members are in the close position, the operating component magnetically maintains the body in the other of the switch states and overcomes the magnetic correlation between the body and the biasing component. Importantly, the switch assembly housing is oriented with the axis thereof being substantially horizontal so that, if a defeat magnet is placed against the one member on the exterior of the structure, the defeat magnet will shift the body to the one switch state notwithstanding the close position of the first and second members. This serves to initiate an alarm or the like to thus warn of the attempted unauthorized entry. Preferably, the central axis of the switch unit is ±10° relative to the horizontal.

In certain embodiments, the electrically conductive body with in the switch unit is in the form of a spherical ball form of a permanently magnetic material. Correspondingly, the biasing member may be formed of a ferromagnetic material to establish the desired magnetic correlation.

BRIEF DESCRIPTION OF THE DRAWINGS

FIG. 1 illustrates a preferred wireless magnetic switch apparatus in accordance with the invention, shown mounted on the inside of a door frame and door;

FIG. 2 is a perspective view of the switch assembly forming a part of the apparatus of FIG. 1;

FIG. 3 is a perspective view of the operating component assembly forming a part of the apparatus of FIG. 1;

FIG. 4 is a view similar to that of FIG. 2, but having portions of the switch assembly housing removed to reveal the internal contents thereof;

FIG. 5 is an enlarged, fragmentary sectional view of the switch apparatus of FIG. 1, depicting the switch assembly and operating component assembly mounted on the door frame and door, with the door in a closed position;

FIG. 5A is a fragmentary enlarged view of the switch apparatus, and depicting the internal arrangement of the and switch assembly and the operating component assembly;

FIG. 6A illustrates the switch apparatus of FIG. 6, but showing the switch state of the switch assembly when the door is open;

FIG. 7A is a view similar to that of FIG. 7, but illustrating the switch state of the switch assembly during the attempted unauthorized opening.

DETAILED DESCRIPTION OF THE PREFERRED EMBODIMENT

Figure 6:
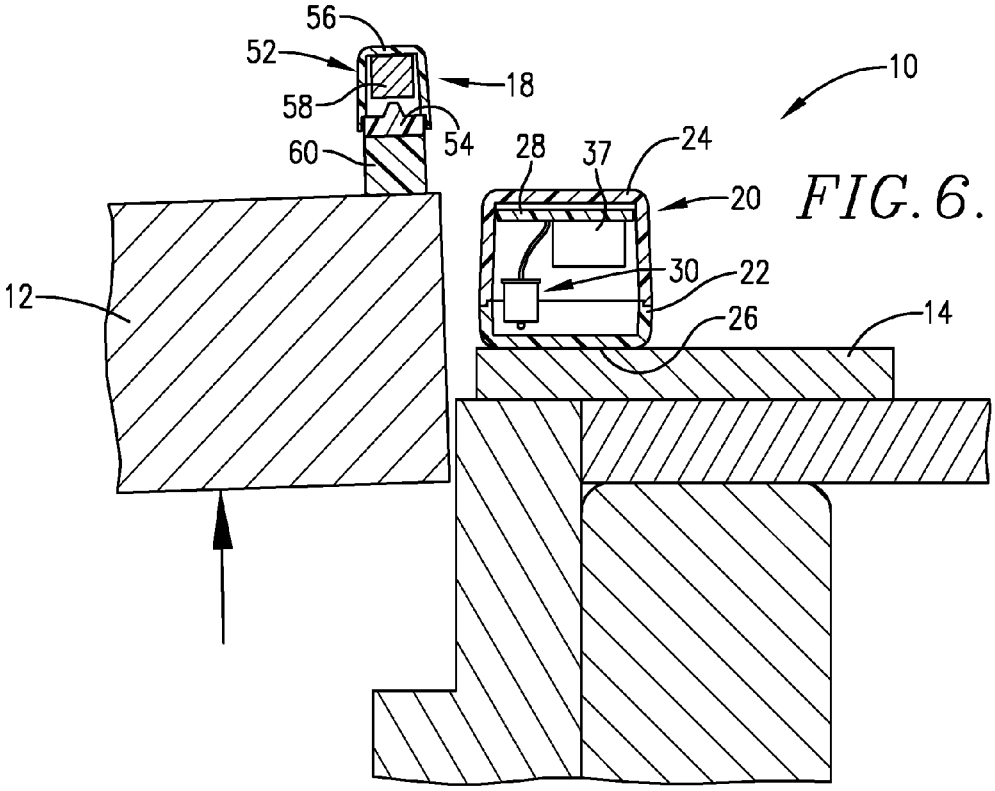
FIG. 6 illustrates the switch apparatus during opening of the door.

Turning now to the drawings, a wireless switch apparatus 10 in accordance with the invention is illustrated when mounted on the interior of a door 12 and door frame 14. Broadly speaking, the apparatus 10 includes a wireless magnetic switch assembly 16, usually mounted on frame 14, and an associated operating component assembly 18, usually mounted on door 12. The apparatus 10 is designed to operate in the event of an unauthorized opening of door 12, by initiating the operation of a local alarm and/or signaling a monitored alarm controller.

The switch assembly 16 includes an elongated synthetic resin housing 20 having a base 22 and cap 24, with the base 22 having a mounting surface 26. Internally, the assembly 16 includes a printed circuit board 28, a magnetic switch unit 30, a battery holder 32, and a battery 34. Electrical leads 36, 38 electrically couple the switch unit 30 to board 28. The board has conventional alarm circuitry as well as an alarm/wireless module 37 permitting sounding of an audible alarm and/or wireless interconnection of the switch 30 to a controller so that the state of the switch 30 is reported to the controller. Any type of wireless module may be used, such as a Bluetooth module, or wireless signal generators, e.g., radio frequency (RF), infrared (IR), or any other appropriate electromagnetic regime.

The construction of the switch unit 30 is illustrated in FIGS. 5A-7A, and includes an elongated, tubular, metallic housing or can 40 having an integral outer wall 42 and an opposed metallic closure cap 44. The latter has a central synthetic resin dielectric insert 46 and covers the inner end of the can 40. The lead 36 passes through the insert 46 and extends into the confines of can 40, as illustrated. The lead 38 is secured to the cap 44 and is thus electrically connected with can 40. A biasing component 48 is affixed to the outer surface of wall 42. A magnetically shiftable body, here in the form of a spherical ball 50, is located within the can 40 and is movable therein between two switch states, namely a first state illustrated in FIG. 5A where the ball 50 is in simultaneous electrical contact with the lead 36 and can 40 (and thus lead 38), and a second state illustrated in FIGS. 6A and 7A where the ball 50 is out of such simultaneous contact. Thus, it will be appreciated that the leads 36 and 38 (together with can 40) define first and second, spaced apart, electrically conductive switch elements.

The switch unit 30 and biasing component 48 are magnetically correlated, such that when the door 12 is opened relative to frame 14 (FIGS. 6 and 6A), the biasing component 48 serves to magnetically shift and maintain the ball 50 in the second switch state wherein the ball 50 is out of simultaneous contact with the switch elements. In this embodiment, the ball 50 is formed of magnetic material, whereas the component 48 is ferromagnetic; of course, this arrangement could be reversed. The only important feature is that there be an appropriate magnetic correlation between the ball 50 and component 48.

The operating component assembly 18 includes a synthetic resin housing 52 having a base 54 and a cap 56. An operating component 58 is located within the housing 52, as shown. The operating component 58 is magnetically correlated with the switch 30, so that, when the door 12 and frame 14 are in the closed position, the operating component magnetically shifts and maintains the ball 50 in the first switch state and overcomes the magnetic correlation between the ball 50 and biasing component 48. Here again, the operating component 58 may be a permanent magnet or formed of a ferromagnetic material, so long as the appropriate magnetic correlation is maintained between the component 58 and ball 50.

The apparatus 10 is positioned as shown in FIGS. 1 and 5, with the mounting surface 26 of base 22 affixed to the door frame 14, and with the operating component assembly 18 secured to door 12 by means of a standoff spacer 60, so that the magnet 58 is strategically located relative to switch assembly 16, as explained herein. The battery 34 forming a part of assembly 16 provides operating power to the circuit board 28 and associated components.

The normal operation of switch assembly 10 is illustrated in FIGS. 5, 5A, 6, and 6A, where the alarm system is armed and will activate in the event of an attempted illegal entry. Turning first to FIGS. 5 and 5A, the door 12 is shown in the closed position within frame 14. In this configuration, the adjacent operating component 58 serves to magnetically move ball 50 to the first switch state depicted in FIG. 5A, in this instance where the ball is in simultaneous contact with the leads or switch elements 36, 38. So long as there is no attempted illegal entry, the apparatus 10 will remain in this standby condition.

In the event of an attempted unauthorized opening where the door 12 is moved to an open position relative to frame 14 (FIGS. 6 and 6A), the operating component assembly 18 is moved away from the switch assembly 16. When this occurs, the magnetic correlation between ball 50 and component 48 comes into play, which serves to shift ball 50 to the second switch position out of simultaneous contact with the switch elements 36, 38. This serves to initiate operation of the alarm system.

Figure 7:
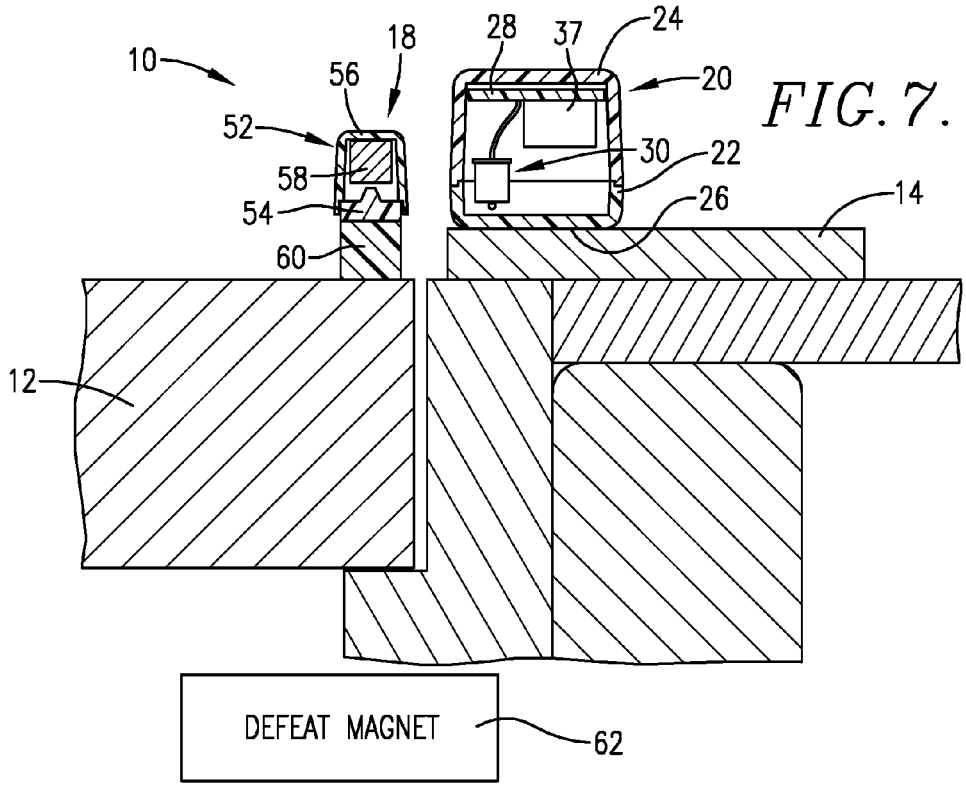
FIG. 7 is a view similar to that of FIG. 5, but illustrating an attempted unauthorized opening of the door using an external defeat magnet.

The use of a defeat magnet 62 in an effort to overcome switch apparatus 10 is illustrated in FIGS. 7 and 7A. In this case, a defeat magnet is placed on an exterior surface (i.e., outside of the protected building or structure) adjacent the door 12 and door frame 14. However, owing to the substantially horizontal orientation of switch unit 30, the defeat magnet only serves to move the ball 50 from the standby position of FIG. 5A to the alarm-initiation position of FIG. 6A. Hence, the mere placement of the defeat magnet 62 serves to trigger the alarm system.

Although the switch unit 30 has been described making use of a spherical ball 50, the invention is not so limited. That is, the shiftable body may be of any suitable design so long as it meets the dictates of the present invention, thus, the body may be square or arcuate, so long as it is properly shiftable within the housing. Moreover, while the invention is shown in the context of protecting a door 12 within a frame 14, the switch apparatus of the invention may be used in any other context where separable members are provided, for example a sliding window.

I claim:

1. Magnetic switch apparatus for detecting relative movement between first and second members from a close position wherein the members are proximal, and an open position where the members are separated, said first and second members providing a potential entryway from the exterior of a structure to the interior thereof, said apparatus comprising:

a switch assembly for mounting on one of said members in the interior of said structure and including— an elongated housing presenting a central axis and having first and second, spaced apart, electrically conductive switch elements;

a shiftable, electrically conductive body within said housing and movable between a first switch state wherein said body is in simultaneous contact with said first and second switch elements, and a second switch state wherein said body is not in simultaneous contact with said first and second switch elements;

a biasing component proximal to said housing, said biasing component and said body being magnetically correlated such that when the first and second members are in said open position, said biasing component magnetically maintains said body in one of said switch states; and an operating component configured for mounting on the other of said members in the interior of said structure, said operating component and switch assembly being magnetically correlated such that when said first and second members are in said close position, said operating component magnetically maintains said body in the other of said switch states and overcomes the magnetic correlation between said body and said biasing component, said switch assembly housing being oriented with the axis thereof being substantially horizontal so that, if a defeat magnet is placed against said one member on the exterior of said structure, said defeat magnet will shift said body to said one of said switch states notwithstanding the close position of said first and second members, said first switch element being an elongated lead extending into said housing, and said housing serving as said second switch element.

2. The switch apparatus of claim 1, said electrically conductive body being in the form of a spherical ball.

3. The switch apparatus of claim 1, said electrically conductive body being formed of a permanently magnetic material.

4. The switch apparatus of claim 1, said central axis being ±10° relative to the horizontal.

5. The switch apparatus of claim 1, said biasing component being secured to said housing.

6. The switch apparatus of claim 1, said first and second members being a door and door frame, respectively.

7. The switch apparatus of claim 1, said one switch state being when said body is in simultaneous contact with said first and second switch elements, and said other of said switch states being when said body is out of said simultaneous contact.

8. Magnetic switch apparatus for detecting relative movement between first and second members from a close position wherein the members are proximal, and an open position where the members are separated, said first and second members providing a potential entryway from the exterior of a structure to the interior thereof, said apparatus comprising:

a switch assembly for mounting on one of said members in the interior of said structure and including— an elongated housing presenting a central axis and having first and second, spaced apart, electrically conductive switch elements;

a shiftable, electrically conductive body within said housing and movable between a first switch state wherein said body is in simultaneous contact with said first and second switch elements, and a second switch state wherein said body is not in simultaneous contact with said first and second switch elements;

a biasing component proximal to said housing, said biasing component and said body being magnetically correlated such that when the first and second members are in said open position, said biasing component magnetically maintains said body in one of said switch states; and an operating component configured for mounting on the other of said members in the interior of said structure, said operating component and switch assembly being magnetically correlated such that when said first and second members are in said close position, said operating component magnetically maintains said body in the other of said switch states and overcomes the magnetic correlation between said body and said biasing component, said switch assembly housing being oriented with the axis thereof being substantially horizontal so that, if a defeat magnet is placed against said one member on the exterior of said structure, said defeat magnet will shift said body to said one of said switch states notwithstanding the close position of said first and second members, said first and second members being a door and door frame, respectively.

9. The switch apparatus of claim 8, said electrically conductive body being in the form of a spherical ball.

10. The switch apparatus of claim 8, said electrically conductive body being formed of a permanently magnetic material.

11. The switch apparatus of claim 8, said central axis being ±10° relative to the horizontal.

12. The switch apparatus of claim 8, said biasing component being secured to said housing.

13. The switch apparatus of claim 8, said one switch state being when said body is in simultaneous contact with said first and second switch elements, and said other of said switch states being when said body is out of said simultaneous contact.

14. The switch apparatus of claim 8, said first switch element being an elongated lead extending into said housing, said housing serving as said second switch element.

* * * * *